US006108877A

United States Patent [19]

Anscher et al.

[11] Patent Number: 6,108,877

[45] Date of Patent: Aug. 29, 2000

[54] TENSION FASTENER

[75] Inventors: Joseph Anscher, Muttontown; Raymond Cappiello, Stony Brook, both of N.Y.

[73] Assignee: National Molding Corporation, Farmingdale, N.Y.

[21] Appl. No.: 09/207,495

[22] Filed: Dec. 8, 1998

[51] Int. Cl.[7] ..... A44B 21/00

[52] U.S. Cl. ..... 24/481; 24/482; 24/495; 24/134 R; 24/132 R

[58] Field of Search ..... 24/481, 482, 487, 24/495, 505, 579, 265 CD, 265 BC, 265 EC, 132 R, 133, 134 L, 132 WL, 19, 273, 70 CT, 70 ST, 134 R; 224/651

[56] References Cited

U.S. PATENT DOCUMENTS

| | | | |
|---|---|---|---|
| 1,859,365 | 5/1932 | Johnson | 24/495 X |
| 3,967,349 | 7/1976 | Christensen | 24/132 R X |
| 5,165,148 | 11/1992 | Fleischer et al. | 24/495 X |
| 5,285,556 | 2/1994 | Shorin et al. | 24/487 |
| 5,408,729 | 4/1995 | Schwatz et al. | 24/134 R |
| 5,435,045 | 7/1995 | Anscher | 24/482 |

*Primary Examiner*—Anthony Knight
*Assistant Examiner*—Robert J. Sandy
*Attorney, Agent, or Firm*—Collard & Roe, P.C.

[57] ABSTRACT

A tension fastener for securing elongated implements to a backpack or other device. The fastener comprises a base that has a bar for attaching it to a strap, a hook disposed on the top surface of the base near one of its ends, and two parallel channels for adjustably receiving and securing a cord. The fastener also comprises a cover having a bar mounted across one end and an aperture extending through its sides on the other end. There is a cord threaded through the aperture in the cover and secured in the receiving and securing means in the base to connect the cover to the base. An implement is secured to the fastener by placing the implement on the top surface of the base, placing the cover over the implement, sliding the bar of the cover over the hook on the base, and tightening the cord until the desired tension is achieved. This fastener is easily operated using only one hand and securely keeps the implement attached to the backpack.

12 Claims, 6 Drawing Sheets

TENSION FASTENER

BACKGROUND OF THE INVENTION

1. Field of the Invention

This invention relates to a tension fastener for use on backpacks and other carriers. In particular, this invention relates to a tension fastener that can secure hiking tools such as an ice axe or walking stick to a backpack.

2. The Prior Art

In hiking and climbing, it is common for the participants to carry tools such as ice axes and walking sticks. Often, these tools are secured to the outside of backpacks by various attachment mechanisms. One of the most common mechanisms includes a loop and an adjustable strap and buckle combination. The loop is attached to the lower part of the back surface of the backpack, and the strap and buckle combination is attached to the upper part of the back surface. In the case of an ice axe, the hammer end of the tool is typically inserted and twisted in the loop and the handle end of the tool is held against the backpack by the strap and buckle.

Although this arrangement can securely hold an ice axe in place, it has several drawbacks. The strap and buckle can be difficult to manipulate, especially in cold and snowy conditions where the user is wearing gloves or mittens. Engagement, disengagement, and adjustment of the strap and buckle typically involves feeding and winding the strap through the buckle cross bars and teeth, which may be difficult when wearing gloves, and impossible when wearing mittens. Another disadvantage is the teeth of the buckle will wear and fray the strap after repeated use, which can result in an insecure fastening.

A solution to this problem has been proposed by U.S. Pat. No. 5,435,045 to Anscher. This patent discloses a fastener comprised of a pair of interlocking members coupled by an elastic cord. The cord is looped around a strap on the backpack and tightened to the desired tension. The pair of members are then interlocked around the ice axe or other tool to keep it in place. The interlocking connection comprises a protruding hook on one member and a keyhole-shaped aperture on the other member. The hook is inserted through the aperture to interlock the two members and secure the tool to the backpack.

While this arrangement is an improvement over the conventional buckle assembly, it still requires both hands to secure the tool to the backpack and can be difficult to operate if the user is wearing mittens.

SUMMARY OF THE INVENTION

It is therefore an object of the present invention to provide a fastener for use on a backpack that can be easily operated with mitten-clad hands.

It is another object of the invention to provide a fastener for use on a backpack that can be operated using only one hand.

It is another object of the invention to provide a fastener for use on a backpack that can securely hold a variety of tools, such as ice axes, walking sticks, pick axes and other tools.

It is a further object of the invention to provide a fastener for use on a backpack in which the tension on the fastener can be easily adjusted with one hand.

These and other objects of the invention are accomplished by a fastener for use on a backpack comprising a base and a cover that are secured together by a cord. The base has a bottom surface, two lateral sides and two ends, a hook disposed on its top surface near one of its ends, and two parallel channels for adjustably receiving and securing a cord. The cover has a bar mounted across one end and an aperture extending through its sides on the other end. There is a cord threaded through the aperture in the cover and secured in the parallel channels in the base to connect the cover to the base. The cord is preferably an elastic BUNGEE®-type cord. An implement is secured to the fastener by placing the implement on the top surface of the base, placing the cover over the implement, sliding the bar of the cover over the hook on the base, and tightening the cord until the desired tension is achieved.

Alternative ways of locking the cover to the base could also be used. For example, the base could have a bar and the cover could have a hook. Alternatively, the base and cover could be locked together via a side-release male-female type buckle assembly. Any suitable means for releasably locking one end of the cover to the base could be employed, as long as it can be actuated easily using only one hand.

The base is attached to a strap on the backpack via two bars mounted on opposite lateral sides of the base. Each bar has a transverse slit therein for threading a strap through the bars. This allows the fastener to be securely attached to a strap that does not have any free ends, i.e., if the strap is sewn to the backpack at both of its ends. Thus, the center of the strap can be slid in to the space between the body of the base and the bars through each of the transverse slits. Each slit is preferably displaced from the center of the bar to allow for easier insertion of the straps.

Because the implements to be fastened to the backpack, i.e., ice axes, walking sticks, etc. usually have round or at least convex cross sections, the top surface of the base and the bottom surface of the cover are preferably concave to easily accommodate these implements in between the cover and the base.

In a preferred embodiment, the base is preferably perforated with a series of holes, and a pad is placed over the top surface of the base. The pad can have protrusions that snap into the holes in the base. The pad acts to add friction between the base and the implement to prevent the implement from sliding out of the fastener during use. This is especially important if the implement is a walking stick that is not secured at its bottom to the backpack via other means.

The base and cover are preferably made of a rigid polymeric material such as nylon or acetal, so that they are lightweight yet can withstand sufficient stresses.

A cord is secured through the base via two parallel channels extending from the end of the base opposite the end nearest the hook and terminating at two slits in the base near the hook. The slits extend from the top surface of the base to the parallel channels. There are two L-shaped channels extending from the top surface of the base to the end nearest the hook, such that the cord extends through one L-shaped channel, up over the top surface of the base, through the slit and through one parallel channel, through the aperture in the cover, through the other parallel channel in the base, up to the top surface of the base through the slit, and through the other L-shaped channel to connect the cover to the base.

The base preferably has a pressure surface mounted adjacent the hook. The pressure surface has an upward angle and provides leverage to a user's finger when securing and releasing the latching means from the hook. The cover also has an extending lip on its end opposite the bar to add coverage to the users's thumb when securing and releasing the cover. The pressure surface and the lip allows the fastener to be operated with one hand.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
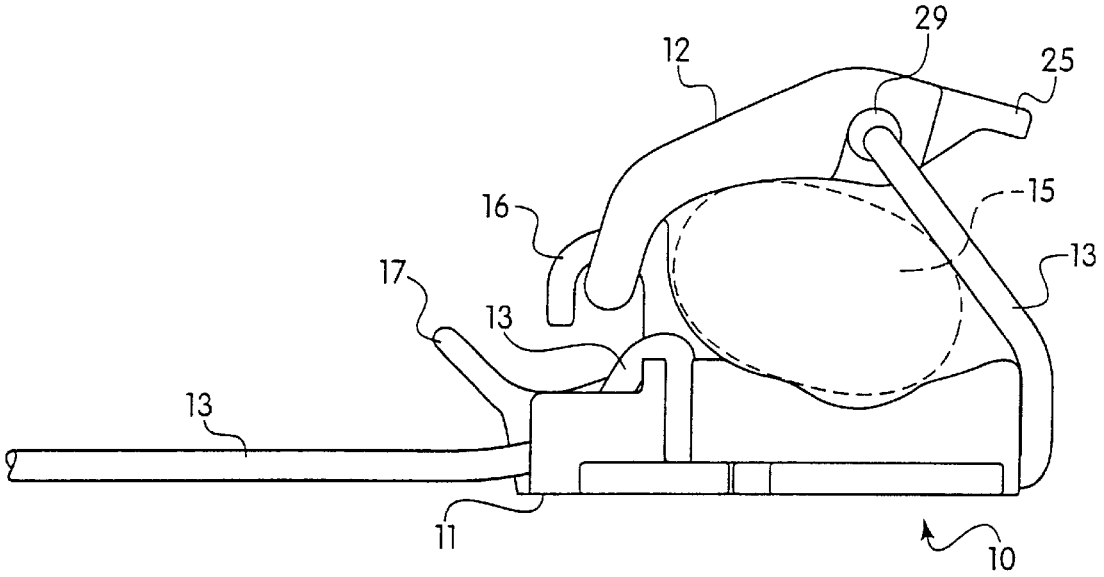
FIG. 1 shows a side view of the fastener according to the invention having an implement mounted therein.
Figure 2:
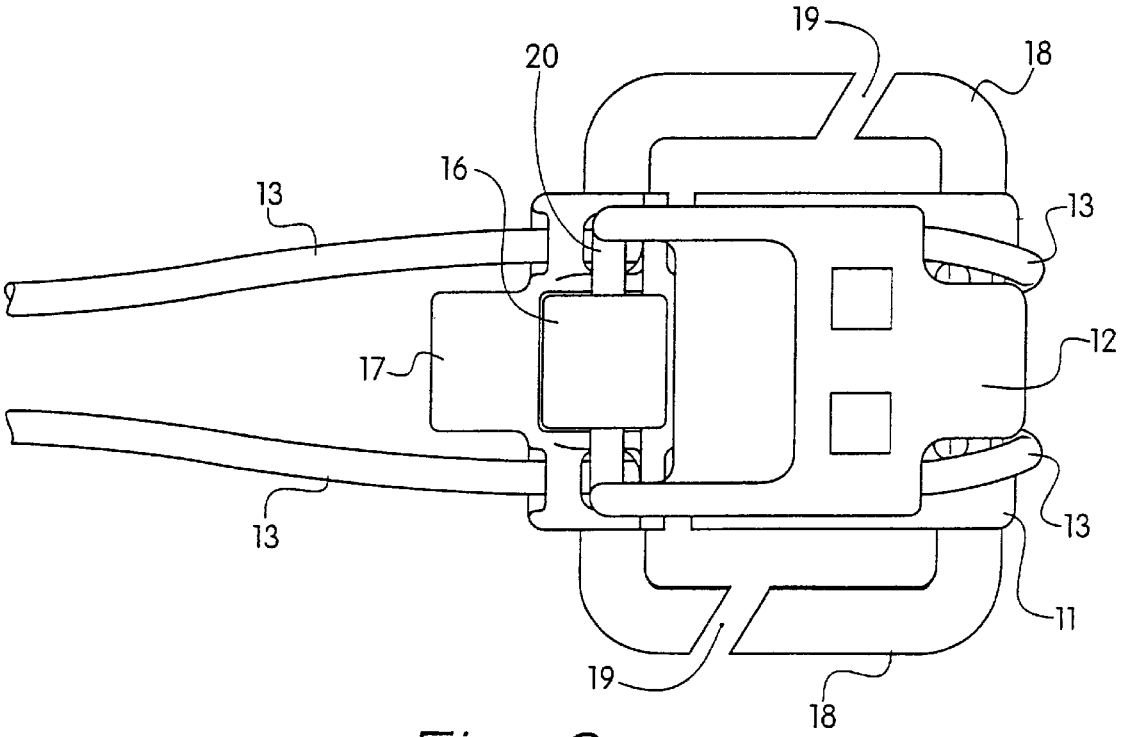
FIG. 2 shows a top view of the fastener according to the invention in the locked position.
Figure 3:
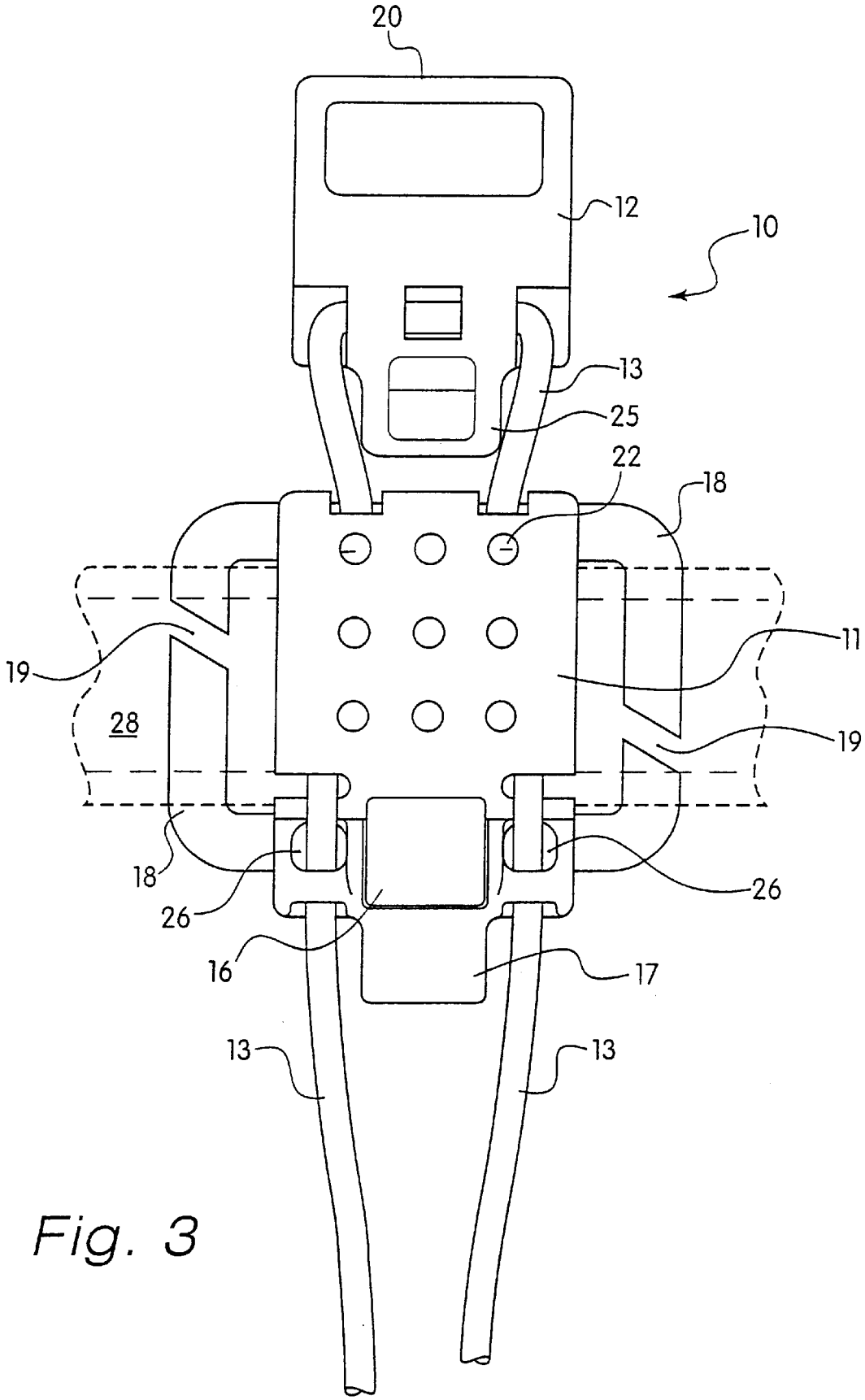
FIG. 3 shows a top view of the fastener in the open position with straps threaded through the base.

Referring now in detail to the drawings and, in particular, FIGS. 1–3, there is shown the fastener 10 according to the invention. Fastener 10 is comprised of a base 11 and a cover 12. Base 11 and cover 12 are connected to each other at one end via a elastic cord 13 threaded through the components. As shown in FIG. 1, an implement 15 is placed between base 11 and cover 12 and is fastened by securing bar 20 of cover 12 around hook 16 of base 11. The tension on the fastener is adjusted by tightening cord 13 after fastener 10 is locked around implement 15. A pressure surface 17 is positioned near hook 16 on base 11 to provide leverage to a user's fingers when fastening bar 20 around hook 16. The end of cover 12 opposite bar 20 has an extending lip 25 that also provides leverage to a user's fingers to allow fastener 10 to be locked and unlocked. This way, fastener 10 can be locked and unlocked using only one hand.

As shown in FIGS. 2 and 3, base 11 is equipped with two bars 18 on opposite sides for allowing a strap 28 to be threaded through base 11. Each bar 18 has a transverse slit 19 for allowing a strap with no free ends to be threaded through as well. Preferably, each slit 19 is disposed off-center in the bars, to allow strap 28 to be attached and detached more easily.

The central part of base 11 is preferably perforated with a plurality of holes 22. This allows a pad 35 (shown in FIG. 6) to be snapped into the base to add additional friction to keep implement 15 from sliding out.

Figure 4:
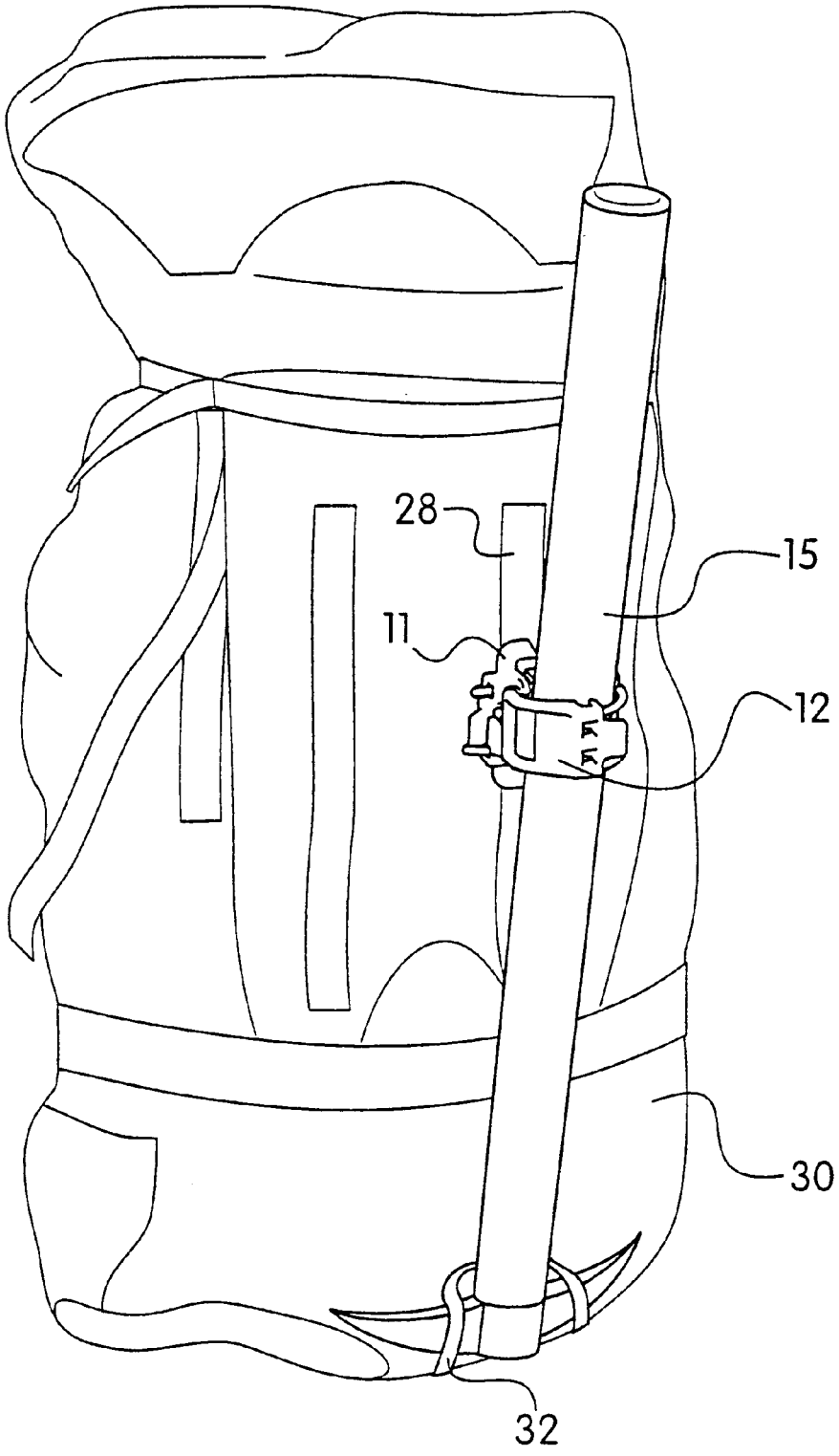
FIG. 4 shows a front view of the fastener as mounted to a backpack.

FIG. 4 shows fastener 10 in use as attached to a backpack 30 and holding an ice axe 15. Fastener 10 is attached to strap 28, and then ice axe 15 is secured to fastener 10 by locking cover 11 onto base 12. The head of ice axe 15 is secured in place by a loop 32 on the bottom of backpack 30.

Figure 5:
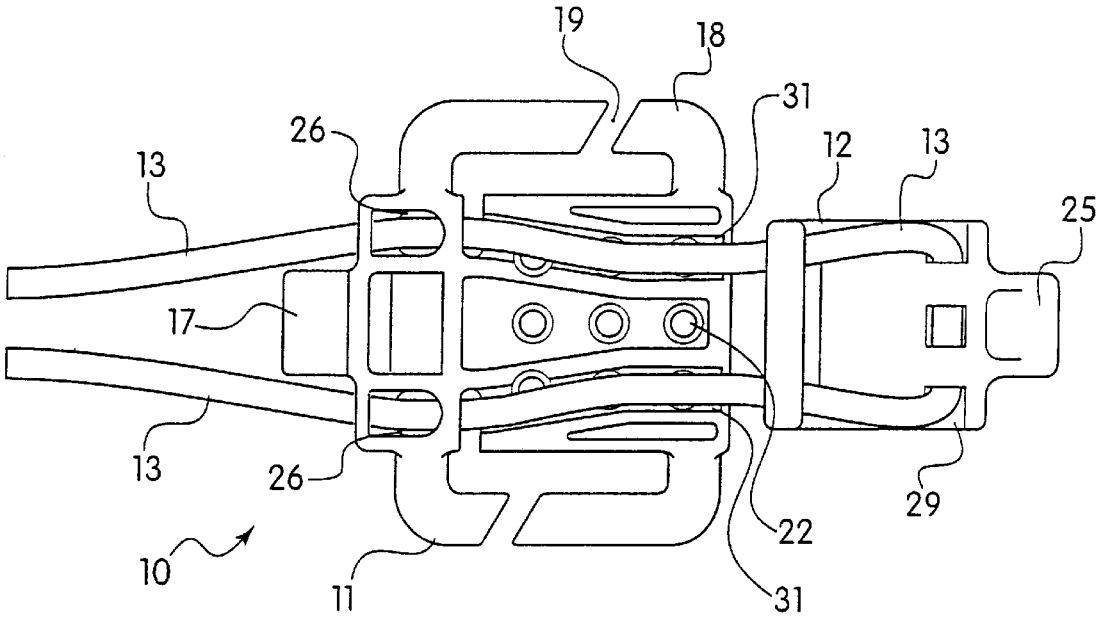
FIG. 5 shows a bottom view of the fastener.

The underside of fastener 10 is shown in FIG. 5. Bungee cord 13 is threaded through a channel 29 in cover 12. Bungee cord 13 is then threaded through channels 31 in base 11 and through an L-shaped channel 26 to exit out the opposite end of base 11. The ends of cord 13 can be pulled to tighten fastener 10 around an implement after fastener 10 is locked.

Figure 6:
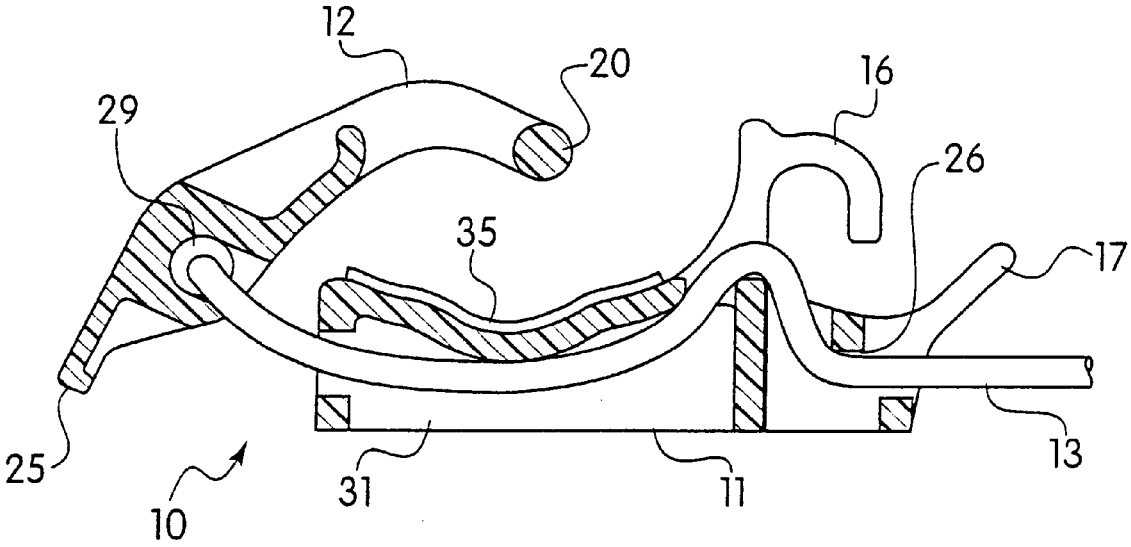
FIG. 6 shows a cross-sectional view of the fastener in the open position.
Figure 7:
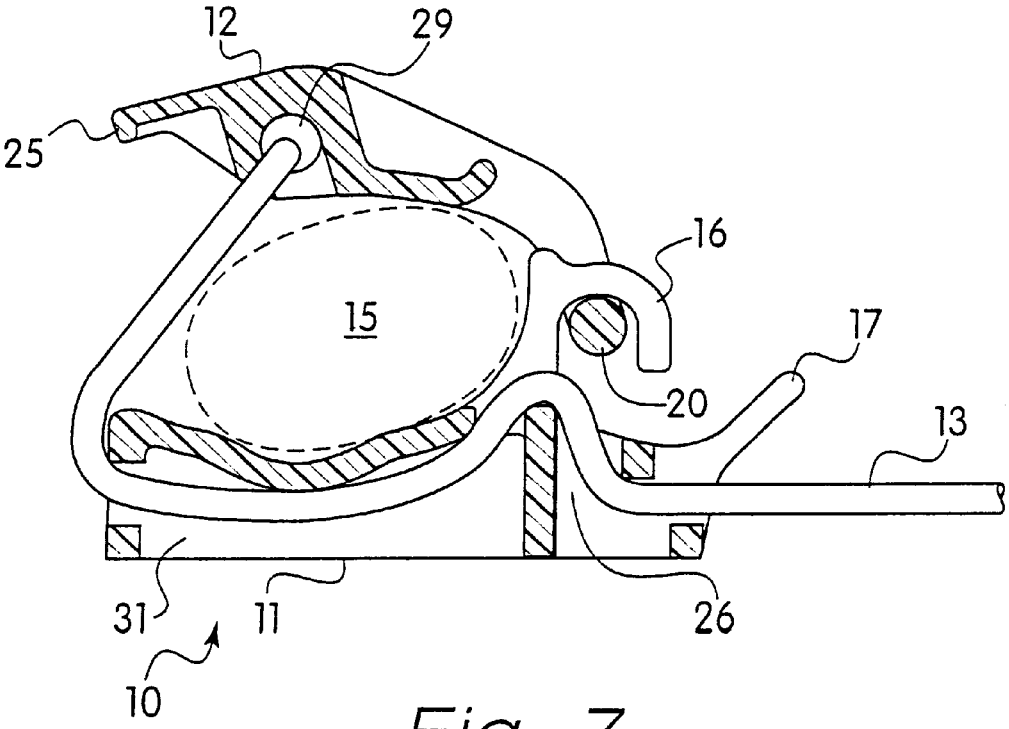
FIG. 7 shows a cross-sectional view of the fastener in the locked position.

FIGS. 6 and 7 show cross-sectional views of fastener 10 in the locked and unlocked positions. Cord 13 is securely held in base 11 by its position in L-shaped channel 26 so that the tension between cover 12 and base 11 is maintained and implement 15 is held in place. Pressure surface 17 and extending lip 25 provide leverage to a user's fingers and thumb to allow cover 12 to be locked and unlocked on base 11 with only one hand, even if the user is wearing mittens or gloves.

Figure 8:
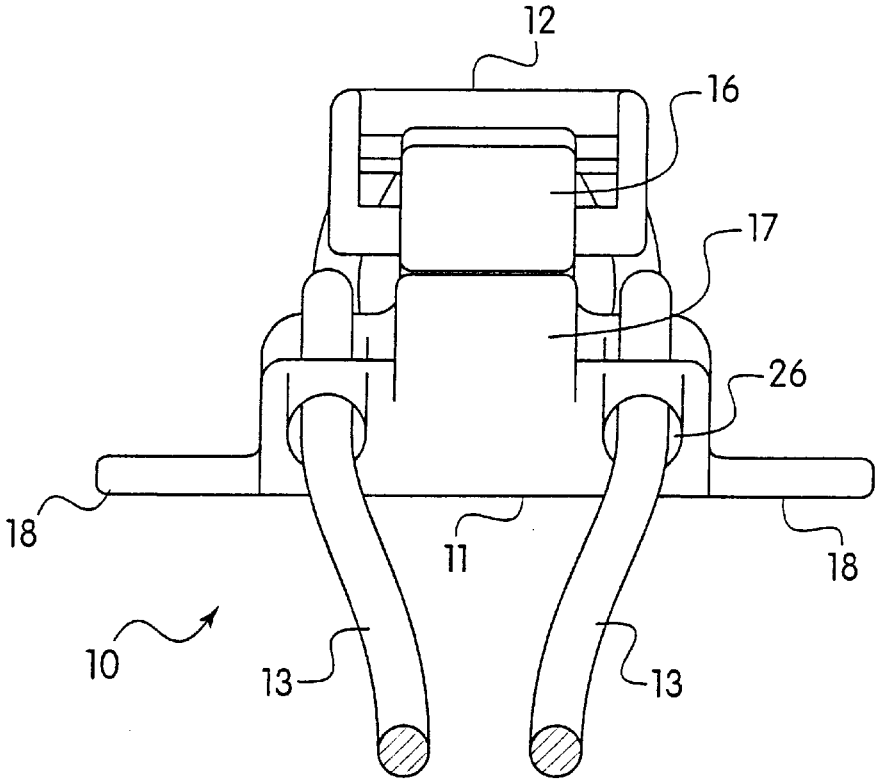
FIG. 8 shows a front end view of the fastener.
Figure 9:
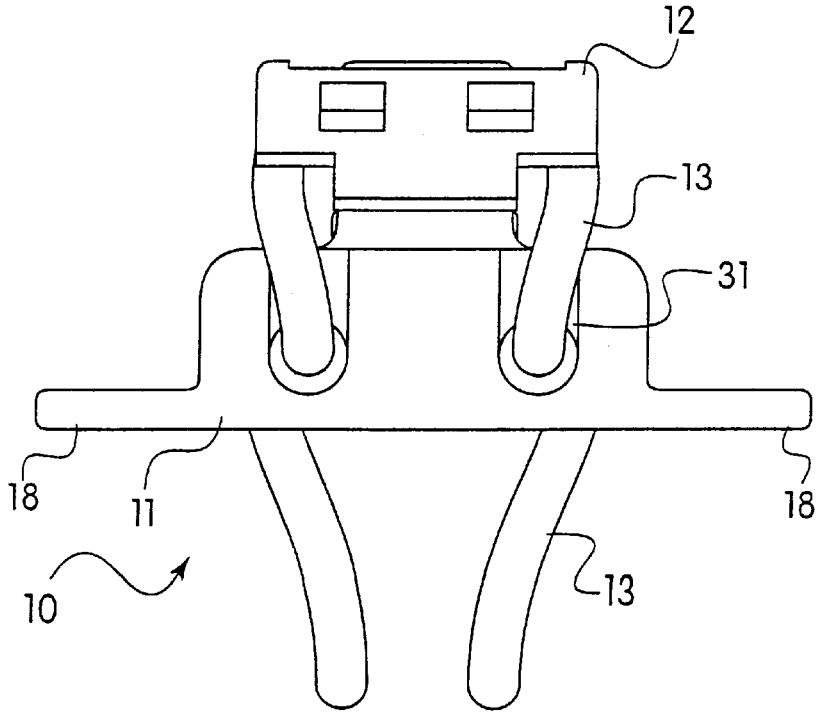
FIG. 9 shows a back end view of the fastener.

FIGS. 8 and 9 shows end views of fastener 10 according to the invention in the locked position. Fastener 10 is easily manufactured in its separate pieces, and then simply assembled by attaching base 11 and cover 12 to each other via cord 13.

Accordingly, while only a single embodiment of the present invention has been shown and described, it is obvious that many changes and modifications may be made thereunto without departing from the spirit and scope of the invention.

What is claimed is:

1. A tension fastener comprising:

a base having a top surface, a bottom surface, two lateral sides and two ends, (a) means for attaching the base to a strap; and (b) means for adjustably receiving and securing a cord;

a cover having a top surface, a bottom surface, two lateral sides and two ends and having an aperture extending through said lateral sides adjacent one end;

means for locking the other end of the cover to the base; and a cord threaded through the aperture in the cover and secured in the receiving and securing means in the base to connect the one end of the cover to the base, wherein an implement is secured to the fastener by placing the implement on the top surface of the base, placing the cover over the implement, securing the locking means, and tightening the cord until the desired tension is achieved.

2. The fastener according to claim 1, wherein the means for locking the other end of the cover to the base comprises a hook disposed on the top surface of the base adjacent one of said ends, and a latching bar disposed on one end of the cover, wherein the bar slides over the hook to lock the fastener closed.

3. The fastener according to claim 1, wherein the means for attaching the base to a strap comprises two strap bars mounted on opposite lateral sides of the base, each strap bar having a transverse slit therein for inserting a strap between the strap bars.

4. The fastener according to claim 3, wherein each slit is displaced from the center of the strap bar.

5. The fastener according to claim 1, wherein the top surface of the base and the bottom surface of the cover are concave.

6. The fastener according to claim 1, further comprising a plurality of holes in the base.

7. The fastener according to claim 1, further comprising a pad attached to the top surface of the base, said pad adding friction to retain the implement in the fastener.

8. The fastener according to claim 1, wherein the base and cover are made of a rigid material.

9. The fastener according to claim 1, wherein the means for receiving and securing a cord through the base comprises two parallel channels extending from the end of the base opposite the end nearest the hook and terminating at two slits in the base near the hook, said slits extending from the top surface to the parallel channels, and two L-shaped channels extending from the top surface of the base to the end nearest the hook, such that said cord extends through one L-shaped channel, up over the top surface of the base, through one of said slits and through one of the parallel channels, through the aperture in the cover, through the other parallel channel in the base, up to the top surface of the base through the other of said slits, and through the other L-shaped channel to connect the cover to the base.

10. The fastener according to claim 1, further comprising a pressure surface mounted to the base adjacent the hook, said pressure surface having an upward angle and providing leverage to a user's finger when securing and releasing the latching means from the hook.

11. The fastener according to claim 1, wherein the cord is an elastic cord.

12. The fastener according to claim 1, wherein the cover further comprises an extending lip located on the end nearest the aperture for providing leverage to a user's thumb when securing and releasing the locking means.

* * * * *